US006796609B2

(12) United States Patent
Illulian

(10) Patent No.: US 6,796,609 B2
(45) Date of Patent: Sep. 28, 2004

(54) SLIPCOVER WITH T-CUSHION FEATURE

(75) Inventor: David Illulian, Beverly Hills, CA (US)

(73) Assignee: Classic Slipcovers Inc., Vernon, CA (US)

( * ) Notice: Subject to any disclaimer, the term of this patent is extended or adjusted under 35 U.S.C. 154(b) by 0 days.

(21) Appl. No.: 10/207,491

(22) Filed: Jul. 29, 2002

(65) Prior Publication Data

US 2004/0017101 A1 Jan. 29, 2004

(51) Int. Cl.[7] ..... A47C 31/00; A47C 27/00

(52) U.S. Cl. ..... 297/218.1; 297/219.1; 297/225; 297/228; 297/228.1; 297/229

(58) Field of Search ..... 297/218.1, 219.1, 297/224, 225, 227, 228, 228.1, 228.11, 229

(56) References Cited

U.S. PATENT DOCUMENTS

| | | | | |
|---|---|---|---|---|
| 2,667,211 A | | 1/1954 | Krasnov et al. | |
| RE24,279 E | | 2/1957 | Schutte et al. | |
| 2,895,542 A | * | 7/1959 | Schutte | 297/219.1 |
| 3,116,953 A | * | 1/1964 | Sugarman | 297/225 |
| 3,195,950 A | * | 7/1965 | Mednick | 297/227 |
| 4,838,610 A | | 6/1989 | Perrin | 297/225 |
| 5,549,355 A | | 8/1996 | Illulian | 297/224 |
| 5,664,831 A | | 9/1997 | White et al. | 297/225 |
| 5,664,832 A | | 9/1997 | Stevens et al. | 297/225 |
| 6,116,685 A | | 9/2000 | White | 297/218.1 |
| 6,409,264 B1 | | 6/2002 | Palmer et al. | 297/218.3 |

* cited by examiner

*Primary Examiner*—Peter M. Cuomo
*Assistant Examiner*—Sarah C. Burnham
(74) *Attorney, Agent, or Firm*—Notaro & Michalos P.C.

(57) ABSTRACT

A semi-fitted furniture slipcover covers a piece of seating furniture having at least one arm and at least one T-cushion with a projection extending in front of the arm. The slipcover has back, front, seat, arm, lower and side panels that are connected to each other. The lower, seat, side and arm panels each having portions adjacent the arm front and T-cushion projection that form a T-cushion assembly. The assembly has a slot between the arm front and the T-cushion projection and is form fit. The assembly also has no part that extends under the T-cushion.

3 Claims, 3 Drawing Sheets

FIG. 2
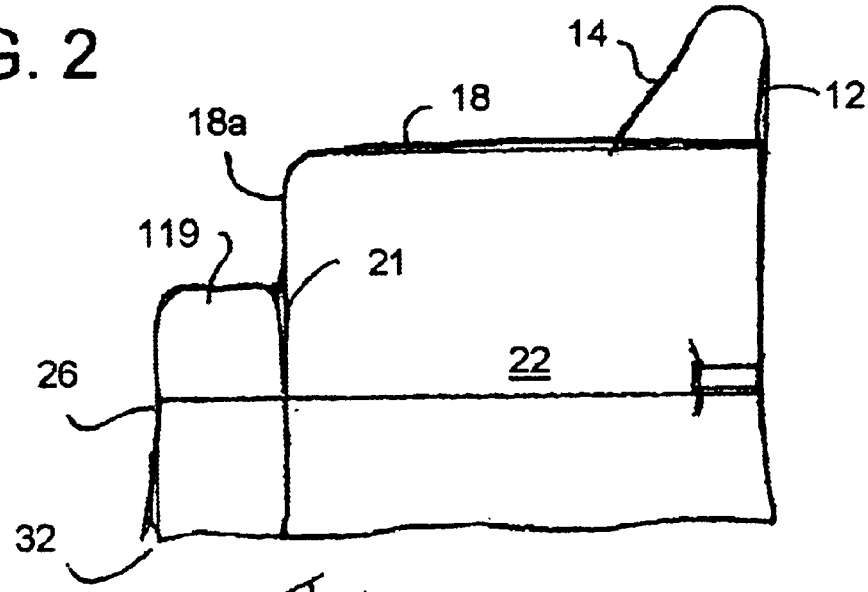
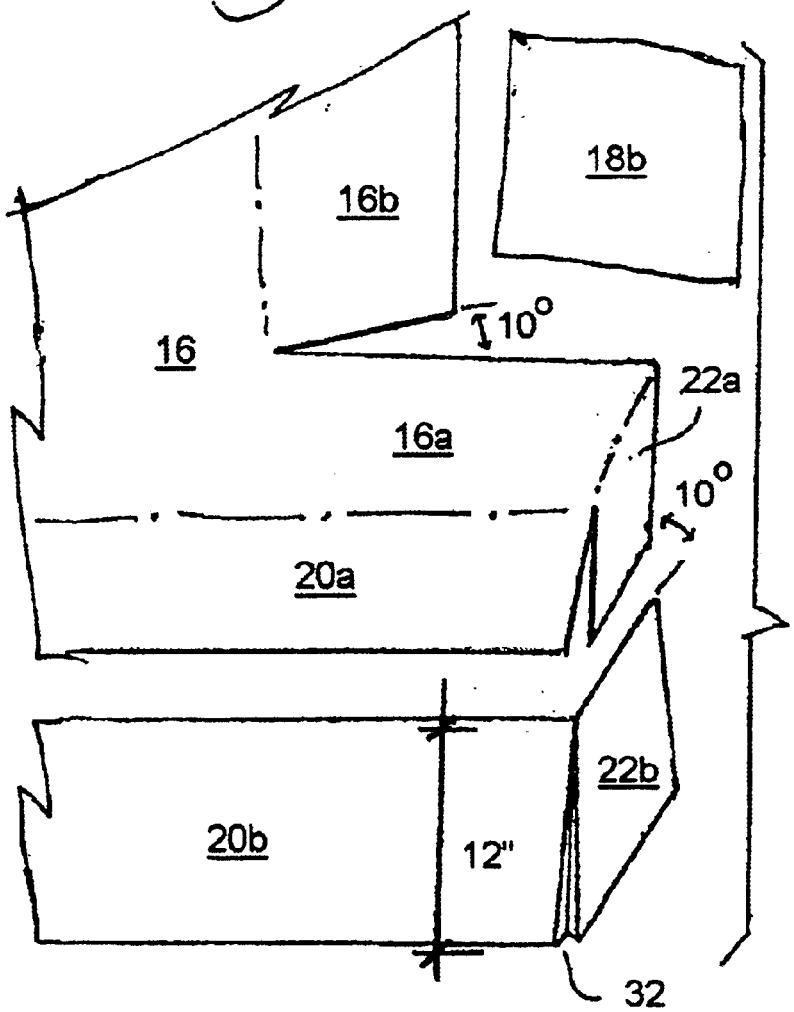
FIG. 3

SLIPCOVER WITH T-CUSHION FEATURE

FIELD AND BACKGROUND OF THE INVENTION

The present invention relates in general to fabric slipcovers for covering furniture, and in particular, to a new and useful semi-fitted slipcover with provision for closely covering a T-cushion.

It is known to cover various pieces of seating furniture such as sofas, love seats and chairs, with fabric slipcovers. These slipcovers were traditionally custom cut and fitted by skilled workers and thus were quite expensive. If the owner of the furniture piece wished to buy a different piece of furniture of the same style, the fitted cover of the older piece could not be used for the new piece, particularly if the new piece was larger than the old piece.

U.S. Pat. No. 5,549,355 to the subject inventor discloses a slipcover having an elastic band stitched at selected positions along the inside of the cover such that when the cover is placed on a furniture piece, such as a sofa or chair, the cover takes the shape of the furniture piece, thus eliminating the time consuming and expensive steps which were required to fit a cover to the furniture piece.

U.S. Pat. No. 5,547,249 discloses a slipcover which is not fitted but which requires the use of stabilizing devices with the slipcover to shape it to the furniture piece.

Some furniture has so-called T-cushions, which are seat cushions that have short projections which extend across the front of the arm or arms of the furniture. These T-cushions are particularly difficult and usually expensive to fit. They can be draped by unfitted slipcovers in a rather sloppy manner, for example see U.S. Pat. No. 4,838,610, or fit with individually cut and sewn cushion covers that are unique for each cushion and thus expensive to make and usable only with cushions of the same size.

A need remains for a versatile, semi-fitted slipcover which can be used on various shapes and sizes of seating furniture that includes at least one (but generally two) T-cushions.

SUMMARY OF THE INVENTION

It is an object of the present invention to provide a semi-fitted furniture slipcover for covering a piece of seating furniture having a body, a back extending upwardly from the body, at least one arm extending upwardly of the body, a seat with at least one T-cushion over the body, and the T-cushion having a projection extending in front of the arm.

Another object of the invention is to provide such a slipcover which comprises: a back panel for covering a back surface of the furniture back; a front panel connected to the back panel for covering top and front surfaces of the furniture back; a seat panel connected to the front panel for covering the furniture seat including a top surface of the T-cushion; an arm panel connected to the front and seat panels, for covering inner, outer, top and front surfaces of the arm; a lower panel connected to the seat panel for covering a front surface of the furniture body; and a side panel connected to the lower and arm panels for covering a side surface of the furniture arm and body; the lower, seat, side and arm panels each having portions adjacent the arm front and T-cushion projection which are connected to each other to together form a T-cushion assembly, the assembly having no part extending under the T-cushion and a slot between the arm front and the T-cushion projection, and being form fit to the lower, seat, side and arm panel portions that are adjacent the arm front and T-cushion projection; all of the panels being sewn to each other to form a one-piece slipcover for the furniture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 2 is a side elevational view of FIG. 1;

FIG. 3 is a perspective view of the T-cushion assembly before it is assembled;

DESCRIPTION OF THE PREFERRED EMBODIMENTS

Figure 1:
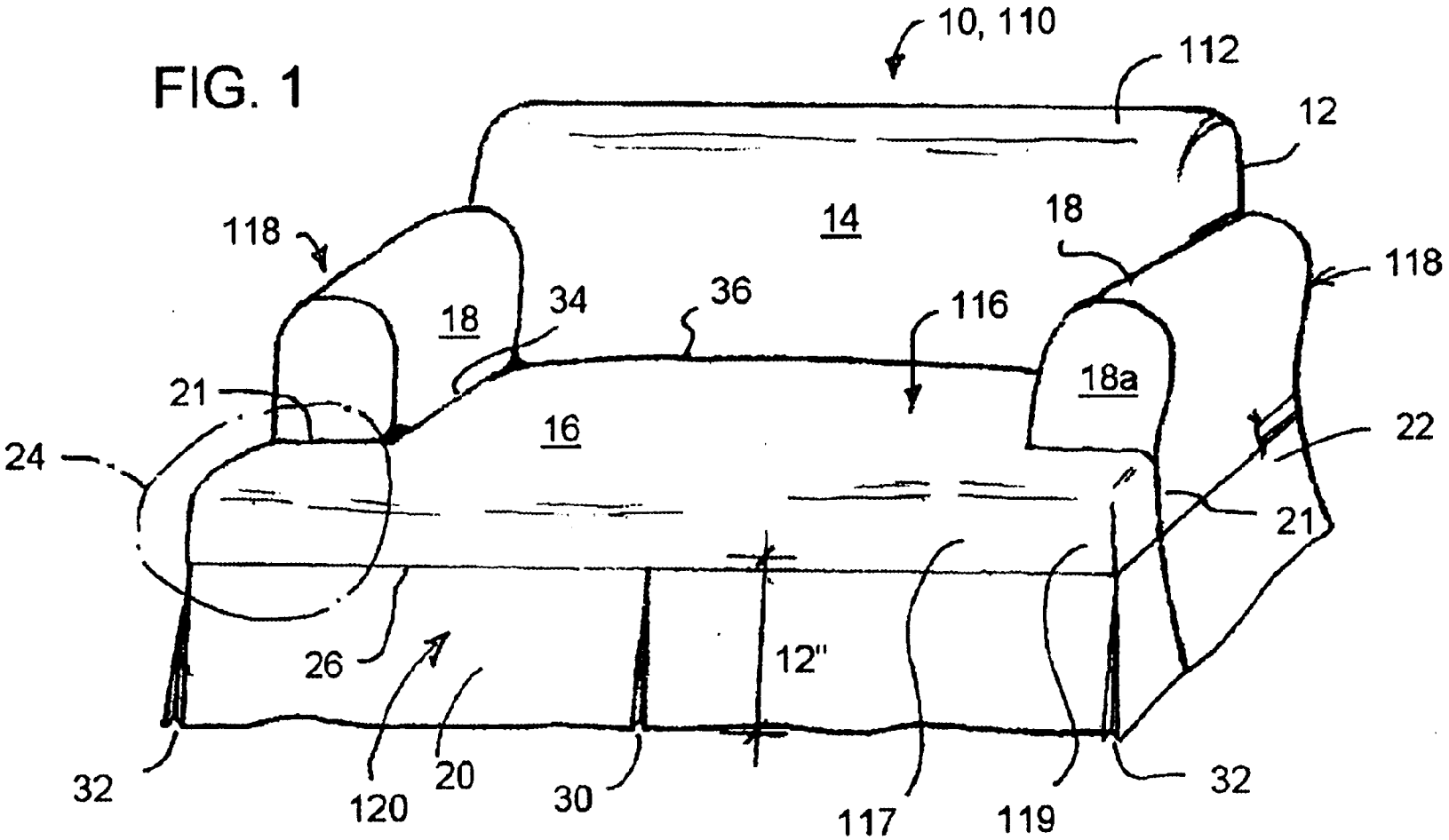
FIG. 1 is a front, side, top perspective view of the slipcover of the invention, fitted onto a love seat.
Figure 5:
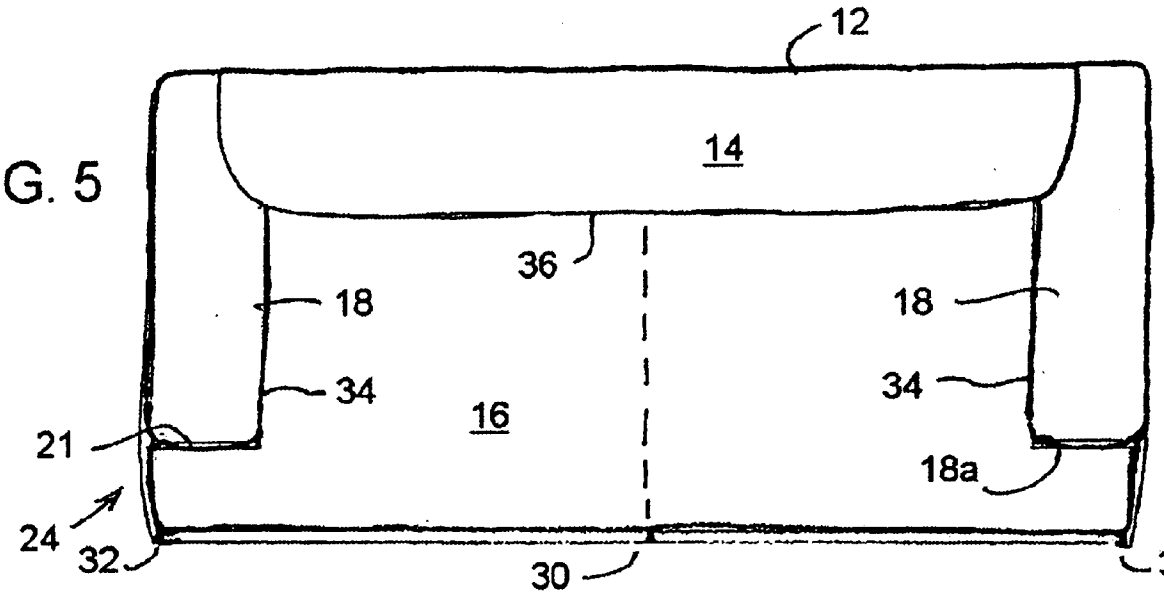
FIG. 5 is a top plan view of the slipcover on a sofa with a T-cushion.

Referring now to the drawings, FIGS. 1, 2 and 5 show a semi-fitted slipcover 10 for covering a piece of seating furniture that is under the slipcover in FIG. 1. Although covered, the contours and parts of the piece of seated furniture 110 can be seem in FIG. 1 as including a body 120 at the bottom which is usually supported above the floor by four or more legs (not shown). The furniture 110 also has a back 112 extending upwardly from the body 110, at least one, but usually two arms 118 extending upwardly from the body, and a seat 116 with at least one T-cushion 117 over the body. The T-cushion, which is also covered by the same, one piece slipcover 10, has a projection 119 extending in front of the arm 118.

The slipcover 10 comprises a back panel 12 for covering a back surface of the furniture back 112, a front panel 14 connected to the back panel for covering top and front surfaces of the furniture back 112 and a seat panel 16, connected to the front panel for covering the furniture seat 116, including a top surface of the T-cushion 117 and its extension 119.

An arm panel 18 is connected to the back, front and seat panels 12, 14, 16, for covering inner, outer, top and front surfaces of the arm 118. A lower panel 20 is connected to the seat panel 16 for covering a front surface of the furniture body 120. A side panel 22 is connected to the arm and lower panels 18, 20 for covering a side surface of the furniture arm and body.

The lower, seat, side and arm panels each having portions adjacent the arm front and T-cushion projection 119 that are connected to each other, and together form a solid polygonal T-cushion enclosure 24. The enclosure 24 has a slot 21 between the arm front, covered by the arm panel portion 18*a*, and an inside surface of the T-cushion projection 119, and is substantially form fit over furniture parts in this area of the slip cover.

All of the panels are sewn or otherwise connected to each other to form a one-piece slipcover for the furniture, although the seams between parts of fabric forming the various panels need not be at the boundary between panels.

Also, continuous pieces of fabric may extend between panels. The term panel is used simply to designate operative areas of the one-piece slipcover.

Although the T-cushion assembly at one side of the furniture has been discussed, it is understood that a like assembly is provided on the other side for two-armed furniture.

Unlike custom slipcovers which use separately sewn T-cushion covers for the T-cushions, according to the invention, no part of the T-cushion assembly extends under the T-cushion. In stead the T-cushion assembly lies over the T-cushion, its projection and the side and front of the furniture. For esthetics, a sewn seam 26 may be provided at the level of the bottom of the cushions to simulate a custom fit cover that would extend under the cushions.

Extra fabric forming pleats is provided at the center 30 and corners 32 of the slipcover lower and side panels to help ease the fitting operation of the slipcover over the furniture and also for esthetic reasons.

Extra fabric can also be provided at the sides 34 and rear 36 of the seat panel 16, and between the seat panel and the arm 18 and front 14 panels. This extra fabric can be tucked down into the crease that is usually present in seating furniture in these areas.

The term semi-fitted used in this disclosure, refers the substantial form-fit nature of the T-cushion assembly on the portions of the furniture near the T-cushion projection. Since the invention is meant to cover various sizes of sofas, love-seats, arm chairs and one-armed "Cleopatra" type seats, the term substantial form-fit is meant to include loose fits that do not conform exactly to the furniture parts. Also, if a piece of seating furniture with two arms is to be covered, the slipcover has two T-cushion assembles sewn into the structure.

Figure 4:
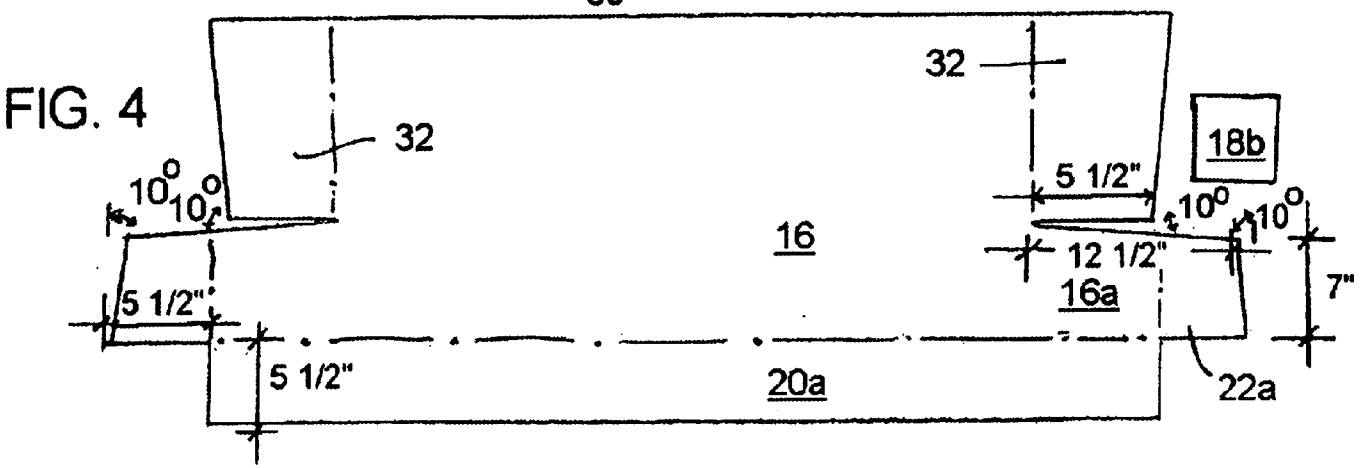
FIG. 4 is a top plan view of a fabric cut and fold pattern for making a key part of the slipcover of the invention.

FIGS. 3 and 4 illustrate key portions of the slipcover for covering T-cushion projection. The fabric that forms the seat panel 16 with an upper part 20*a* of the lower panel and an upper part 22*a* of the side panel is shown in FIG. 4. This is without the additional fabric parts that form the front panel 14, the back panel 12, the arm panels 18, lower side panels 22*b* and a lower part or skirt 20*b* of the lower panel 20. These are all sewn or otherwise attached to the fabric shown in FIG. 4.

The dot-dash lines in FIGS. 3 and 4 indicate so-called mountain folds for the fabric. Mountain folds are convex folds made, for example when the upper side panel portion 22*a* at each side of the fabric pattern in FIG. 4, is folded down into the position shown in FIG. 3. The upper portion 20*a* is likewise folded down and a shirt of fabric made of the lower part 20*b* of the lower panel 20 and the lower part 22*b* of the side panel as well as the pleats 32, are sewn on or otherwise attached.

A lower arm front portion 18*b* shown in FIGS. 3 and 4, is also sewn or otherwise attached to an upper edge of a first seat panel extension 16*a*, in a slot between the first extension 16*a* and a second seat panel extension 16*b*. Panel 18*b* forms the surface of arm panel 18 inside slot 21 between the arm and the T-cushion projection 119.

First extension 16*a* covers the top of T-cushion projection 119 while second extension 16*b* is placed to be pushed down into the crease 34 between the arm 118 and the seat 116.

The fabric part of FIG. 4 is thus T-shaped itself with its upper side portion 22*a* forming the base of the T, and the first 16*a* and second 16*b* extensions, with the upper portion 20*a* of the lower panel 20 forming the cross of the T.

While a specific embodiment of the invention has been shown and described in detail to illustrate the application of the principles of the invention, it will be understood that the invention may be embodied otherwise without departing from such principles.

What is claimed is:

1. A semi-fitted furniture slipcover for covering a piece of seating furniture having a body, a back extending upwardly from the body, at least one arm extending upwardly of the body, and a seat with at least one T-cushion over the body, the T-cushion having a projection extending in front of the arm and the slipcover comprising:

a back panel for covering a back surface of the furniture back;

a front panel connected to the back panel for covering top and front surfaces of the furniture back;

a seat panel connected to the front panel for covering the furniture seat including a top surface of the T-cushion;

an arm panel connected to the front and seat panels, for covering inner, outer, top and front surfaces of the arm, including a lower arm front panel attached to an upper edge of said seat panel and adapted to be inserted between the arm and T-cushion;

a lower panel connected to the seat panel for covering a front surface of the furniture body; and a side panel connected to the lower and arm panels for covering a side surface of the furniture arm and body;

the lower, seat, side and arm panels each having portions adjacent the front surface of the arm end T-cushion projection which are connected to each ether to form a pre-assembled three-dimensional polygonal T-cushion enclosure, the enclosure having no part extending under the T-cushion, projection and defining a slot between the front surface of the arm and the T-cushion projections the enclosure also being substantially form fit to the lower, seat, side and arm panel portions that are adjacent the front surface of the arm and T-cushion projection;

all of the panels being sewn to each other to form a one-piece semi-fitted slipcover for the furniture.

2. As slipcover according to claim 1, including extra fabric between the seat and arm panels end between the seat and front portions for insertion into creases of the furniture.

3. A slipcover according to claim 1, wherein the lower panel and the side panel each include upper and lower parts that are connected to each other at a seam, the upper pails of the lower and side panels forming the lower and side panel portions of the pre-assembled three-dimensional polygonal T-cushion enclosure.

* * * * *